US006811483B1

(12) United States Patent
Webb et al.

(10) Patent No.: US 6,811,483 B1
(45) **Date of Patent: *Nov. 2, 2004**

(54) GAMING DEVICE HAVING A GRADUATING AWARD EXCHANGE SEQUENCE WITH A TEASE CONSOLATION SEQUENCE AND AN INITIAL QUALIFYING SEQUENCE

(75) Inventors: Bayard S. Webb, Sparks, NV (US); Anthony J. Baerlocher, Reno, NV (US); Joseph E. Kaminkow, Reno, NV (US)

(73) Assignee: IGT, Reno, NV (US)

( * ) Notice: Subject to any disclaimer, the term of this patent is extended or adjusted under 35 U.S.C. 154(b) by 185 days.

This patent is subject to a terminal disclaimer.

(21) Appl. No.: 09/680,601

(22) Filed: Oct. 6, 2000

(51) Int. Cl.[7] ..... A63F 9/22
(52) U.S. Cl. ..... 463/16; 463/25; 273/143 R
(58) Field of Search ..... 463/16, 20, 25, 463/30, 31, 36, 43, 46; 273/138.1, 139, 143 R, 269; 283/903

(56) References Cited

U.S. PATENT DOCUMENTS

| | | | |
|---|---|---|---|
| 4,448,419 | A | 5/1984 | Telnaes |
| 4,582,324 | A | 4/1986 | Koza et al. |
| 4,624,459 | A | 11/1986 | Kaufman |
| 4,695,053 | A | 9/1987 | Vazquez, Jr. et al. |
| 4,991,848 | A | 2/1991 | Greenwood et al. |
| 5,178,390 | A | 1/1993 | Okada |
| 5,205,555 | A | 4/1993 | Hamano |
| 5,342,047 | A | 8/1994 | Heidel et al. |

(List continued on next page.)

FOREIGN PATENT DOCUMENTS

| | | |
|---|---|---|
| EP | 0874337 A1 | 10/1998 |
| EP | 0926645 A2 | 6/1999 |

(List continued on next page.)

OTHER PUBLICATIONS

Schwartz, et al., The Encyclopedia of TV Game Shows, 3rd Ed., Checkmark Books (1999), pp. 125–26, 192–93.*

(List continued on next page.)

*Primary Examiner*—Mark Sager
*Assistant Examiner*—Steven Ashburn
(74) *Attorney, Agent, or Firm*—Bell, Boyd & Lloyd LLC

(57) ABSTRACT

The present invention includes a method for operation a gaming device and preferably a bonus round of said device, whereby the game provides the player an initial sequence which results in a successful or unsuccessful outcome. If the player obtains a successful outcome, the player may use an award provided by obtaining said successful outcome. In a subsequent sequence wherein the player can selectively keep an award or attempt to sequentially exchange or trade up to a point or award total that enables the player to obtain a final and desirable ultimate award. The player preferably knows the existence of the ultimate award, and the present invention preferably discloses or reveals the value of the player's currently held or currently obtained award. The game can also reveal the value of the intermediate award steps as the player decides to go for the ultimate award or settle for the currently held award. The game preferably provides a consolation award to a player upon an unsuccessful exchange. The game also preferably provides one or more tease sequences, wherein the game sequentially prompts a player who has decided to risk a current award by upgrading the current award and asking the player to rethink the player's decision.

18 Claims, 9 Drawing Sheets

U.S. PATENT DOCUMENTS 5,456,465 A 10/1995 Durham
5,524,888 A 6/1996 Heidel
5,536,016 A 7/1996 Thompson
5,542,669 A 8/1996 Charron et al.
5,560,603 A 10/1996 Seelig et al.
5,611,535 A 3/1997 Tiberio
5,711,525 A 1/1998 Breeding
5,769,716 A 6/1998 Saffari et al.
5,772,509 A 6/1998 Weiss
5,775,692 A 7/1998 Watts et al.
5,788,573 A 8/1998 Baerlocher et al.
5,823,874 A 10/1998 Adams
5,833,538 A 11/1998 Weiss
5,848,932 A 12/1998 Adams
5,851,148 A 12/1998 Brune et al.
5,873,781 A 2/1999 Keane
5,882,261 A 3/1999 Adams
5,902,184 A 5/1999 Bennett
5,911,418 A 6/1999 Adams
5,941,773 A * 8/1999 Harlick ..... 463/26
5,947,820 A 9/1999 Morro et al.
5,951,397 A 9/1999 Dickinson
5,964,463 A 10/1999 Moore, Jr.
5,967,894 A 10/1999 Kinoshita et al.
5,980,384 A 11/1999 Barrie
5,984,781 A 11/1999 Sunaga
5,997,400 A 12/1999 Seelig et al.
5,997,401 A 12/1999 Crawford
6,004,207 A 12/1999 Wilson, Jr. et al.
6,015,346 A 1/2000 Bennett
6,019,369 A 2/2000 Nakagawa et al.
6,033,307 A 3/2000 Vancura
6,056,642 A 5/2000 Bennett
6,059,289 A 5/2000 Vancura
6,059,658 A 5/2000 Mangano et al.
6,062,980 A 5/2000 Luciano
6,089,976 A 7/2000 Schneider et al.
6,089,977 A 7/2000 Bennett
6,089,978 A 7/2000 Adams
6,093,102 A 7/2000 Bennett
6,102,798 A 8/2000 Bennett
6,120,031 A 9/2000 Adams
6,126,541 A 10/2000 Fuchs
6,126,542 A 10/2000 Fier
6,142,873 A 11/2000 Weiss et al.
6,142,874 A 11/2000 Kodachi et al.
6,142,875 A 11/2000 Kodachi et al.
6,146,273 A 11/2000 Olsen
6,159,095 A 12/2000 Frohm et al.
6,159,096 A 12/2000 Yoseloff
6,159,097 A 12/2000 Gura
6,159,098 A 12/2000 Slomiany et al.
6,162,121 A 12/2000 Morro et al.
6,168,520 B1 1/2001 Baerlocher et al.
6,168,523 B1 1/2001 Piechowiak et al.
6,173,955 B1 1/2001 Perrie et al.
6,174,233 B1 1/2001 Sunaga et al.
6,174,235 B1 1/2001 Walker et al.
6,190,254 B1 2/2001 Bennett
6,190,255 B1 2/2001 Thomas et al.
6,203,429 B1 3/2001 Demar et al.
6,210,279 B1 4/2001 Dickinson
6,213,876 B1 4/2001 Moore, Jr.
6,224,483 B1 5/2001 Mayeroff
6,231,442 B1 5/2001 Mayeroff
6,231,445 B1 5/2001 Acres
6,261,177 B1 7/2001 Bennett
6,302,790 B1 10/2001 Brossard
6,305,686 B1 10/2001 Perrie et al.
6,309,300 B1 10/2001 Glavich
6,312,334 B1 * 11/2001 Yoseloff ..... 273/138.1
6,328,649 B1 12/2001 Randall et al.
6,375,187 B1 4/2002 Baerlocher
6,398,218 B1 * 6/2002 Vancura ..... 273/138.1

FOREIGN PATENT DOCUMENTS

EP 0944030 A2 9/1999
EP 0945837 A2 9/1999
EP 0981119 A2 2/2000
EP 0984408 A2 3/2000
EP 0984409 A2 3/2000
WO WO 9732285 9/1997
WO WO 00/12186 3/2000

OTHER PUBLICATIONS

Afra Zomorodian, The Monty Hall Problem, Jun. 20, 1998, p. 1.*
Adders and Ladders Advertisement written by Barcrest Ltd., published prior to 2000.
American Thunder Screen Shots written by IGT, published in 1998.
Big Bang Piggy Bankin Advertisement written by WMS gaming, Inc., published prior to 2000.
Blackjack/Tweny–One Description written by Hoyle's Rules of Games, published in 1993.
Bonus Spin Red, WHite & Blue Advertisement written by IGT, published in 2000.
Bonus Times Article written by Strictly Slots, published in 2000.
By George written by IGB, published in 2002.
Chutes & Ladders Game Instructions written by Hasbro–Milton Bradley, published in 1999.
Double Diamond Game Descriptions written by IGT printed on Mar. 21, 2001.
Double Up Poker Game Description written by IGT Undated.
Easy Street Advertisements and Articles written by Casino Data Systems, published in 2000.
Elvis Advertisement written by IGT, published in 1999.
Empire Game Advertisement written by AC Coin, published in 1996.
Fire and Fortune Article written by Strictly Slots, published in 2001.
Fox "N" Hound Advertisement written by IGT, published in 2000.
In Between Game Description by IGT, available prior to 2000.
Keep Your Hat On Advertisement written by Aristocrat, published in 2001.
Little Green Men Advertisement and Article written by IGT, Strictly Slots, published in 2000.
MegaJackpots Advertisement written by IGT, published in 1998.
Money Grab Article written by Strictly Slots, published in Apr. 2001.
Money in the Bank Advertisement written by Strictly Slots Konami, published in 2001.
Monopoly Advertisements and Articles written by WMS Gaming, Inc., Strictly Slots, published in 1998, 1999, 2000.
Monopoly Party Train Article written by Strictly Slots, published in 2002.
Neon Nights written by IGT, published in 2000.
On the Money Article written by Strictly SLots, Casino Data Systems, published in Dec. 2000.

Polly & Roger Advertisement written by VLC, Inc., published in 2000.
Price is Right "Cliff Hangers" Description written by www.geocities.com; members.aol.com (web site), printed Mar. 21, 2001.
Price is Right "Showcases" Description written by schuminweb.com (web site), printed Mar. 16, 2001.
Psycho Cash Beast Club (including knockouts) written by Barcrest, published prior to 1998.
Richard Petty Advertisement written by IGT, published in 2000.
Spell Binder Advertisement written by IGT, published in 2000.
Texas Tea Advertisement written by IGT, published in 2000.
Top Cat Advertisement written by WMS Gaming, Inc. published prior to 2000.
Totem Pole Advertisement written by IGT, published in 1997.
Treasure Wheel/Treasure Tunnel Advertisement written by Sigma Game, Inc., published prior to 2000.
Wheel of Fortune Advertisement written by IGT, published in 1998.
Wheel Poker Article written by Strictly Slots (Anchor Games), published in Nov. 2000.
Winning Streak Web Site Description written by WMS Gaming Inc. (web site), printed on Mar. 21, 2001.
X Factor Advertisement and Website Page written by WMS Gaming, Inc., published in 1998.
Top Dollar Brochure published by IGT in 1998.
Jackpot Party Brochure and Articles published by WMS Gaming, Inc. in 1998.
Addams Family Brochure and Article published by IGT, Strictly Slots in 2000.
Wheel of Fortune Brochure published by IGT in 1999.
Sphinx Brochure published Atronic Casino Technology, Ltd. in 1997.
Caribbean Gold II published by Aristocrat Incorporated in 1998.
South Park—Dodgeball Brochure published by IGT in 2000.
Take Your Pick Brochure and Article published by IGT/Anchor Games, Strictly Slots in 1999.
Cash Box Brochure & Article published by Anchor Games, Strictly Slots in 2000.
The Official Let's Make a Deal Website published by Bally Gaming System Website printed on Mar. 16, 2001.
Description of Let's Make a Deal Television Show published by letsmakeadela.com (2 pages) printed on Mar. 16, 2001.
Let's Make a Deal published by geocities.com (2 pages) printed on Mar. 16, 2001.
Let's Make a Deal pubished by geocities.com (10 pages) printed on Mar. 21, 2001.
Let's Make a Deal published by fortunecity.com (4 pages) printed on Mar. 21, 2001.
The Deals of Let's Make a Deal published by Fortunecity.com (2 pages) printed on Mar. 16, 2001.
Let's Make a Deal pblished by Illinoislottery.com (1 page) printed on Mar. 21, 2001.
Let's Make a Deal Game Brochure published by Bally Gaming Systems in 1999.

* cited by examiner

| CONSOLATION AWARDS (64) | PLAYER'S CURRENT AWARD (62) | UPGRADE AWARDS (66) | INCREMENTAL TEASE #1 (68) | INCREMENTAL TEASE #2 (70) | INCREMENTAL TEASE #3 (72) | INCREMENTAL TEASE #4 (74) |
|---|---|---|---|---|---|---|
| 20 | 25 – 100 | 400 – 500 | 20 | 30 | 40 | 50 |
| 100 | 400 – 500 | 700 – 1000 | 50 | 80 | 100 | 150 |
| 300 | 700 – 1000 | 1500 – 3000 | 100 | 200 | 300 | 400 |

76 78 80

FIG. 4

FIG. 5 - INITIATOR SEQUENCE

FIG. 6 – PREFERRED AWARD EXCHANGE SEQUENCE

FIG. 7 – TEASE SEQUENCE

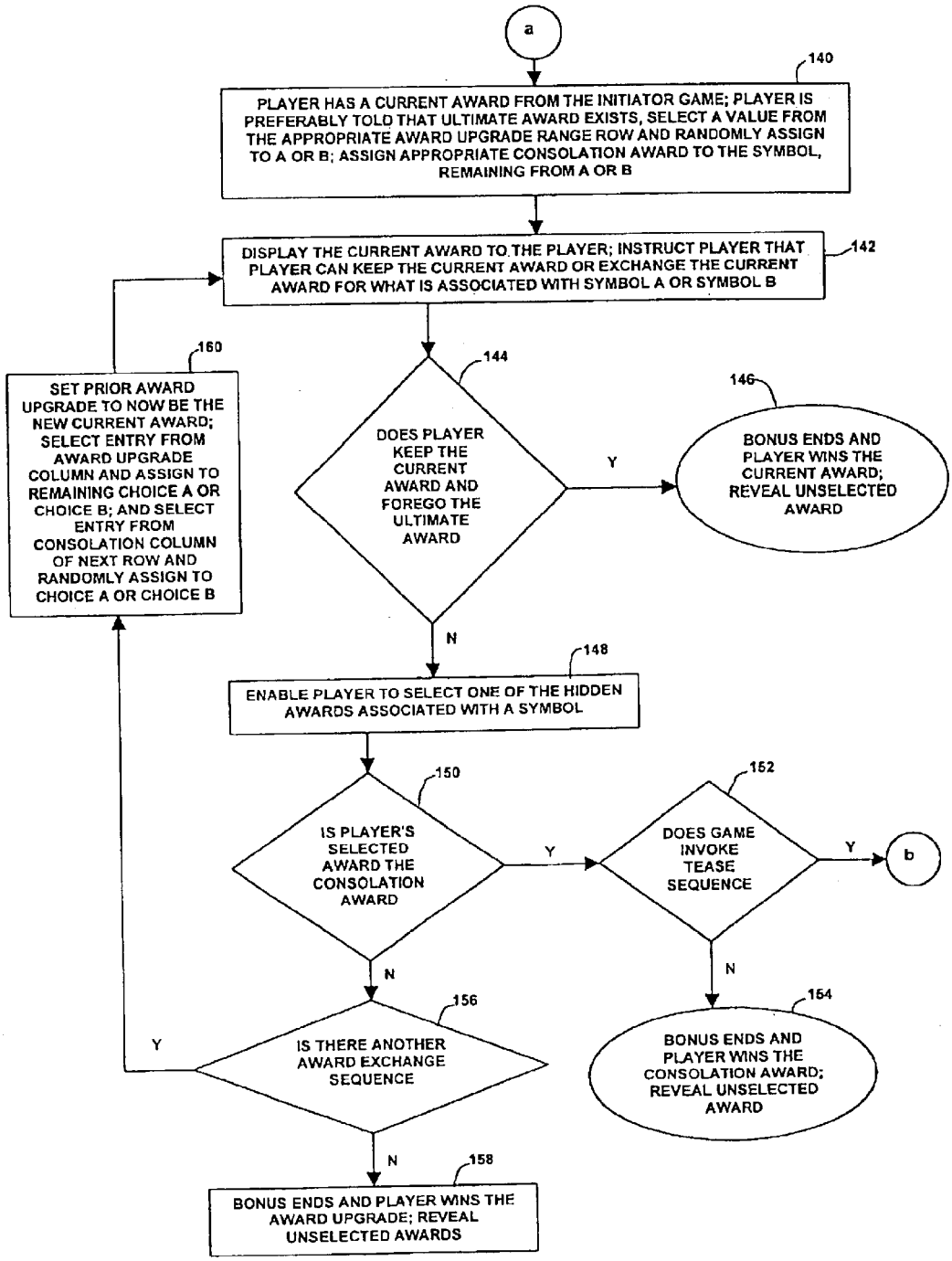
FIG. 9 – ALTERNATIVE AWARD EXCHANGE SEQUENCE

GAMING DEVICE HAVING A GRADUATING AWARD EXCHANGE SEQUENCE WITH A TEASE CONSOLATION SEQUENCE AND AN INITIAL QUALIFYING SEQUENCE

CROSS REFERENCE TO RELATED APPLICATION

This application is related to the following commonly-owned co-pending patent applications: "GAMING DEVICE HAVING SEPARATELY CHANGEABLE VALUE AND MODIFIER BONUS SCHEME," Ser. No. 09/626,045, "GAMING DEVICE HAVING A BONUS ROUND WITH MULTIPLE RANDOM AWARD GENERATION AND MULTIPLE RETURN/RISK SCENARIOS," Ser. No. 09/678,989, "GAMING DEVICE HAVING AN AWARD EXCHANGE BONUS ROUND AND METHOD FOR REVEALING AWARD EXCHANGE POSSIBILITIES," Ser. No. 09/689,510, "GAMING DEVICE HAVING A DESTINATION PURSUIT BONUS SCHEME WITH ADVANCED AND SETBACK CONDITIONS," Ser. No. 09/686,409, "GAMING DEVICE HAVING VALUE SELECTION BONUS," Ser. No. 09/684,605, "GAMING DEVICE HAVING RISK EVALUATION BONUS ROUND," Ser. No. 09/688,434, "GAMING DEVICE HAVING AN IMPROVED OFFER/ACCEPTANCE BONUS SCHEME," Ser. No. 09/966,884, "GAMING DEVICE HAVING IMPROVED OFFER AND ACCEPTANCE BONUS SCHEME," Ser. No. 09/680,630, "GAMING DEVICE HAVING IMPROVED AWARD OFFER BONUS SCHEME," Ser. No. 09/682,368, "GAMING DEVICE HAVING OFFER AND ACCEPTANCE GAME WITH HIDDEN OFFER," Ser. No. 10/160,688, "GAMING DEVICE HAVING OFFER ACCEPTANCE GAME WITH TERMINATION LIMIT," Ser. No. 09/822,711, "GAMING DEVICE HAVING OFFER/ACCEPTANCE ADVANCE THRESHOLD AND LIMIT BONUS SCHEME," Ser. No. 09/838,014, "GAMING DEVICE HAVING IMPROVED OFFER AND ACCEPTANCE GAME WITH MASKED OFFERS," Ser. No. 10/086,014, "GAMING DEVICE HAVING AN OFFER AND ACCEPTANCE SELECTION BONUS SCHEME WITH A TERMINATOR AND AN ANTI-TERMINATOR," Ser. No. 09/945,082, "GAMING DEVICE HAVING AN AWARD OFFER AND TERMINATION BONUS SCHEME," Ser. No. 09/682,428, "GAMING DEVICE HAVING AN OFFER AND ACCEPTANCE GAME WITH A PLAYER SELECTION FEATURE," Ser. No. 10/086,078, and "GAMING DEVICE HAVING IMPROVED OFFER AND ACCEPTANCE BONUS SCHEME," Ser. No. 10/074,273.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device including an initial qualifying sequence followed by a series of graduating player selectable award exchange sequences, and wherein the game can provide one or more consolabon tease sequences when the player decides to exchange a known award.

BACKGROUND OF THE INVENTION

Gaming devices currently exist with bonus rounds in which a player has one or more opportunities to select masked bonus awards from a pattern or group of masked awards displayed to the player. When the player chooses a masked award from the pattern, the game removes the mask and either awards the player with a bonus value or terminates the bonus round with a bonus terminator. The outcome depends upon whether the player selects an award or a terminator.

In the above game, the controller of the gaming device randomly places a predetermined number of masked awards and terminators in the pattern at the beginning of the bonus round and maintains the positioning until the bonus round terminates. When the player selects a masked award, the player receives the value of the award, and the game typically displays a message that the player may continue and enables the player to select another masked award. The player then selects another masked award, and the process continues until the player selects a masked terminator. European Patent Application No. EP 0 945 837 A2 filed on Mar. 18, 1999 and assigned on its face to WMS Gaming, Inc. discloses a bonus scheme of this type.

Gaming machines also currently exist with bonus rounds in which the game selects or determines the player's award. PCT application number PCT/AU97/00121 entitled, Slot Machine Game with Roaming Wild Card, having a publication date of Sep. 4, 1997, discloses an example. In this application, a slot machine having a video display contains a plurality of rotatable reels with game symbols. When the player receives a triggering symbol or combination, the game produces a bonus symbol. The bonus symbol moves from game symbol to game symbol temporarily changing the game symbol to a bonus symbol. If the change results in a winning combination, the player receives an award.

In the first known game, the "go-until" or "do-until" bonus round can end quite quickly if the player selects a terminator early in the bonus round. The player blindly selects masked awards until selecting the bonus terminator, which is immediately displayed. The player knows nothing about the location of any particular award, and there is no logical incentive to select any particular masked award as opposed to any other masked award. Choosing a masked award also poses no risk to a previously accumulated award. That is, there is not incentive to stop selecting. The only logical course is for the player to continue selecting until selecting a terminator. The player's involvement in the bonus round and thus the player's level of enjoyment and excitement from the bonus round is thus limited.

The second known game has even less player interaction. The game completely determines the bonus round award, and the player has no affect on the outcome. The player is a mere observer to the bonus round sequence and participates only by receiving an award. In both games, the player is not prompted to calculate, weigh options, or explore any consequences of any action. To increase player excitement and enjoyment, it is desirable to provide a gaming device, and more specifically a bonus round of a gaming device, which prompts a player to calculate, weigh options and explore the consequences of the player's selection.

In the known "go-until" or "do-until" bonus round, the game reveals all unselected awards and terminators associated with the pattern after the player selects a terminator. The application makes no specific reference as to how or in which manner the game reveals the unselected awards or terminators. Revealing the masks from selected and unselected awards and other gaming device components is well known in the art. No known game, however, reveals awards or other gaming device components in any particular manner or employs any particular method of deciding which CD awards, to reveal first, second, etc. It should be appreciated, that in a game which prompts a player to calculate, weigh options, and explore the consequences of the players selection, it is desirable to reveal the consequences of the player's selection in a manner that maximizes player excitement and enjoyment.

SUMMARY OF THE INVENTION

The present invention provides a method for operation of a gaming device and preferably a bonus round of said device, whereby the player can selectively keep an award or attempt to sequentially exchange or trade up to a point or award total that enables the player to obtain a final and desirable ultimate award. The present invention can disclose the value of the ultimate award, and in either case the player knows the existence of the ultimate award. The present invention preferably discloses or reveals the value of the player's currently held or currently obtained award. The player preferably knows that there is an ultimate award the player has an opportunity to obtain and preferably knows the award the player must risk to obtain the ultimate award. The game can reveal the value of the intermediate award steps as the player decides to go for the ultimate award or settle for the currently held award. The game preferably provides a consolation award to a player upon an unsuccessful exchange and one or more tease sequences described below.

In order for the main award exchange sequence of the present invention to proceed, the player must obtain an initial currently held award. The game can simply provide such an award to the player, e.g., "You now have 50 credits, you can keep them or try for another award." Alternatively, the game contemplates providing an initiator sequence, which is a game in and of itself. If the player is successful in the initiator sequence, the player moves on to the main award exchange sequence for a try at the ultimate award. If not, the player preferably receives a consolation award and the bonus round preferably ends. As disclosed in detail below, the present invention contemplates storing a plurality of initiator games and invoking one of them at the start of the bonus round.

If the player succeeds at the initiator game, the game preferably provides the player with an award that becomes the initial currently held award in the main award exchange sequence of the present invention. The award exchange sequence involves the player successively risking the currently held award for opportunities to trade up to higher and higher awards in order to reach an ultimate award. The player can stop at any point in the succession and keep the currently held award, at which point, the game or the bonus round preferably ends. If the player is unsuccessful in an attempt to trade up, the game preferably provides the player with a consolation award.

The present invention preferably provides one or more tease sequences during the present invention. In a tease sequence, the game sequentially prompts or teases a player who has decided to risk a current award by upgrading the current award and asking the player to rethink the player's decision. The game contemplates providing the tease sequence using a plurality of different methods.

In one method, the game teases or prompts the player with a value higher than the player's currently held award each time the player elects to play for the ultimate award. For example, after electing to risk the player's current award, the game could provide the prompt, "Well, let's see what your decision would be if 20 credits are added to your total." Assuming the player's currently held award is 80 credits, the player can change course and keep the upgraded 100 credits, which the game then awards to the player. If the player continues to play for the ultimate award and risks the 100 credits, the game can continue to upgrade the award, e.g., to 120, 150 credits, etc. Eventually, the game reveals whether the player has successfully advanced towards the ultimate award.

Alternatively, the present invention provides a tease sequence either sporadically or whenever the player unsuccessfully attempts to trade up for the ultimate award. In this instance, the game does not reveal that the player's attempt has been unsuccessful. The player thus believes that the player is playing for the ultimate award and is risking the currently held award. If the player insists on playing for the ultimate award, the game eventually discloses that the player has lost the current award. The consolation tease sequence, in this instance, gives the player a second, third or fourth chance to win more than the player's current award. The game can successively prompt the player, as before, by raising the value a plurality of times before disclosing the player's unsuccessful attempt.

It is therefore an object of the present invention to provide a bonus round of gaming device, wherein the game prompts a player to calculate, weigh options and explore the consequences of the player's selection.

Another object of the present invention is to provide an initial game, wherein the outcome of the initial game determines whether a player can play the main game of the present invention.

A further object of the present invention is to provide a gaming device having a tease sequence, wherein the game sequentially prompts or teases a player who has decided to risk a current award by upgrading the current award and asking the player to rethink the player's decision.

Other objects, features and advantages of the invention will be apparent from the following detailed disclosure, taken in conjunction with the accompanying sheets of drawings, wherein like numerals refer to like parts, elements, components, steps and processes.

BRIEF DESCRIPTION OF THE DRAWINGS

FIG. 4 is a schematic table illustrating one possible database of different values that the present invention can employ;

FIG. 9 is a process flow diagram of an alternative award exchange sequence, wherein the present invention provides a tease sequence when the player unsuccessfully attempts to exchange an award.

DETAILED DESCRIPTION OF THE INVENTION

Gaming Device and Electronics

Figure 1:
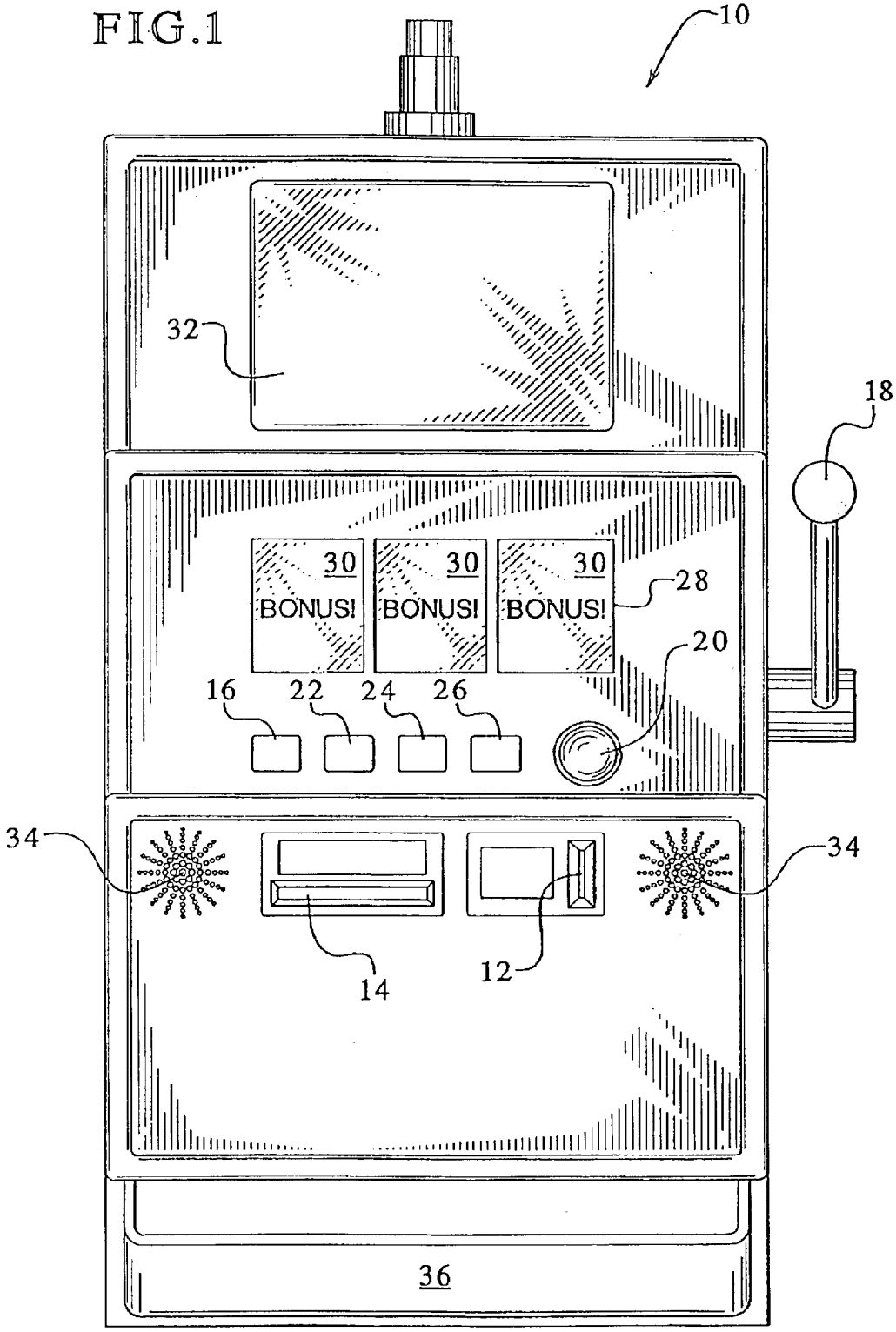
FIG. 1 is a front elevational view of a general embodiment of the gaming device of the present invention.

Referring now to the drawings, FIG. 1 generally illustrates a gaming device 10 of one embodiment of the present invention, which is preferably a slot machine having the controls, displays and features of a conventional slot machine. Gaming device 10 is constructed so that a player can operate gaming device 10 while standing or sitting. However, it should be appreciated that gaming device 10 can be constructed as a pub-style table-top game (not shown) that a player can operate preferably while sitting. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform. Gaming device 10 can incorporate any game such as slot, poker or keno. The symbols used on and in gaming device 10 may be in mechanical, electrical or in video form.

As illustrated in FIG. 1, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. The present invention preferably employs or uses credits, however, the present invention is not limited to the use of credits and contemplates employing other units of value such as money. For purposes of describing and claiming this invention, the term "credit" includes any unit of value such as a gaming device credit or actual money.

After depositing the appropriate amount of money, a player can begin the game by pulling arm 18 or by pushing play button 20. Play button 20 can be any play activator used by the player which starts any game or sequence of events in the gaming device.

Referring to FIG. 1, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

Gaming device 10 also has a display window 28 which contains a plurality of reels 30, preferably three to five reels in mechanical or video form. Each reel 30 displays a plurality of symbols such as bells, hearts, martinis, fruits, cactuses, numbers, cigars, letters, bars or other images, which preferably correspond to a theme associated with the gaming device 10. If the reels 30 are in video form, the gaming device 10 preferably displays the video reels 30 in a display device described below. Furthermore, gaming device 10 preferably includes speakers 34 for making sounds or playing music.

At any time during the game, a player may "cash out" and thereby receive a number of coins corresponding to the number of remaining credits by pushing a cash out button 26. When the player "cashes out," the player receives the coins in a coin payout tray 36. The gaming device 10 may employ other payout mechanisms such as credit slips redeemable by a cashier or electronically recordable cards that keep track of the player's credits.

With respect to electronics, the controller of gaming device 10 preferably includes the electronic configuration generally illustrated in FIG. 2, which has: a processor 38; a memory device 40 for storing program code or other data; a display device 32 (i.e., a liquid crystal display) described below; a plurality of speakers 34; and at least one input device as indicated by block 33. The processor 38 is preferably a microprocessor or microcontroller-based platform that is capable of displaying images, symbols and other indicia such as images of people, characters, places, things and faces of cards. The memory device 40 can include random access memory (RAM) 42 for storing event data or other data generated or used during a particular game. The memory device 40 can also include read only memory (ROM) 44 for storing program code, which controls the gaming device 10 so that it plays a particular game in accordance with applicable game rules and paytables.

Figure 2:
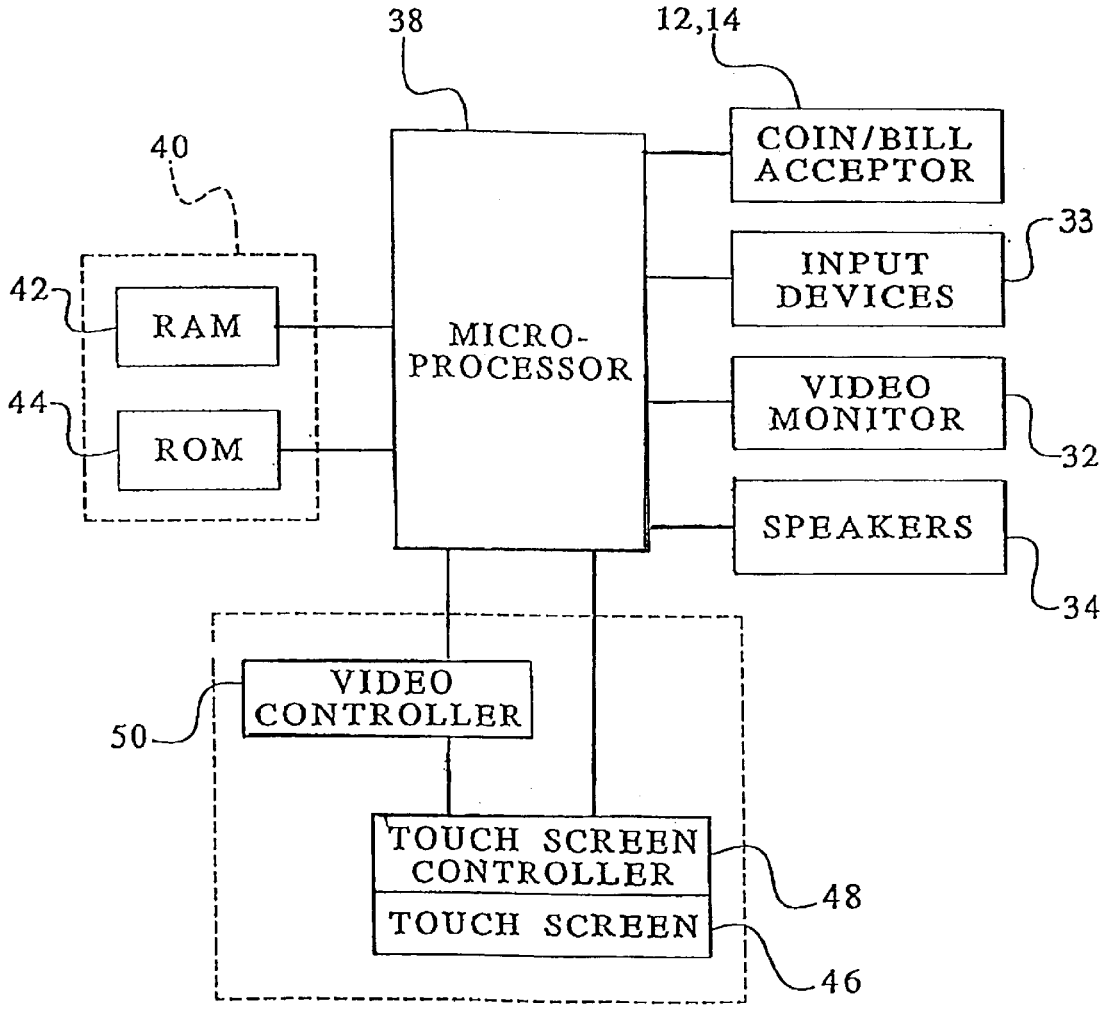
FIG. 2 is a schematic block diagram of the electronic configuration of one embodiment of the gaming device of the present invention.

As illustrated in FIG. 2, the player preferably uses the input devices 33, such as the arm 18, play button 20, the bet one button 24 and the cash out button 26 to input signals into gaming device 10. In certain instances, a touch screen 46 and an associated touch screen controller 48 can be used in conjunction with a display device described in detail below. Touch screen 46 and touch screen controller 48 are connected to a video controller 50 and processor 38. A player can make decisions and input signals into the gaming device 10 by touching touch screen 46 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. For purposes of describing the invention, the controller includes the processor 38 and memory device 40.

Referring to FIGS. 1 and 2, to operate the gaming device 10, the player must insert the appropriate amount of money or tokens at coin slot 12 or bill acceptor 14 and then pull the arm 18 or push the play button 20. The reels 30 will then begin to spin. Eventually, the reels 30 will come to a stop. As long as the player has credits remaining, the player can spin the reels 30 again. Depending upon where the reels 30 stop, the player may or may not win additional credits.

In addition to winning credits in this manner, gaming device 10 also preferably gives players the opportunity to win credits in a bonus round. This type of gaming device 10 will include a program that will automatically begin a bonus round when the player has achieved a qualifying condition in the game. This qualifying condition can be a particular arrangement of indicia on the display window 28. The gaming device 10 also includes a display device such as a display device 32 shown in FIG. 1 enabling the player to play the bonus round. The display device 32 can be any known video monitor, television screen, dot matrix display, CRT, LED, LCD or electro-luminescent display. The display device 32 can be color or monochrome although, preferably, the display is color. Preferably, the qualifying condition is a predetermined combination of indicia appearing on a plurality of reels 30. As illustrated in the three reel slot game shown in FIG. 1, the qualifying condition could be the text "BONUS!" appearing in the same location on three adjacent reels.

Bonus Round Display

The present invention can be employed as a bonus round in a gaming device or a primary game in a gaming device. The main difference between the two is that in a primary game, the player can win nothing. In a bonus round, the game preferably provides at least some consolation award to the player. The present invention is preferably a bonus round of a gaming device and is thus described as such. The present invention, however, is not so limited and can be employed as a primary game in a gaming device.

Figure 3:
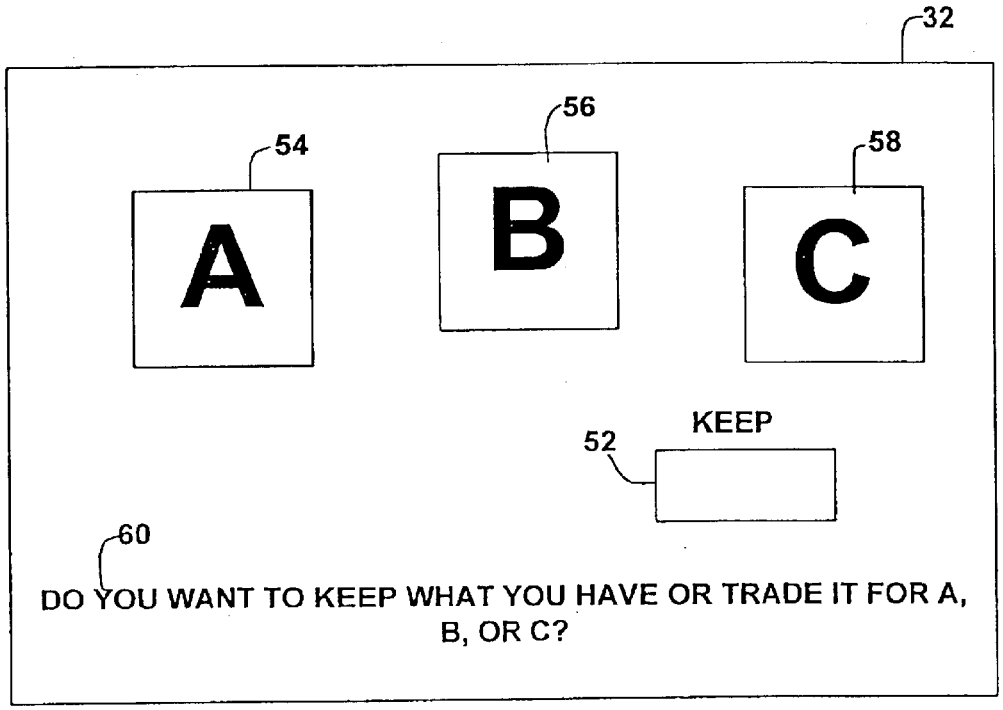
FIG. 3 is an enlarged front plan view of the display device generally displaying the components of the preferred award exchange embodiment of the present invention.

Referring now to FIG. 3, an enlarged front plan view of the display device is shown having the components of the award exchange sequence of the present invention. The display device 32 preferably includes a touch screen 46 and an associated touch screen controller 48 described in connection with FIG. 2. Each of the selectors 52, 54, 56 and 58 associated with the keep feature and the symbols "A", "B" and "C", respectively, on display device 32 is thus preferably a player selectable area, which sends a unique input signal to the controller of the present invention. Alternatively, the present invention contemplates associating one or more front panel mountable input devices 33 (FIG. 2), said input devices being well known in the art, which enable a player keep or to select one of the symbols "A", "B" or "C".

The "keep" selector 52 also preferably updates and displays the value of the player's current award and is thus an indicator as well as a selector. The indicator can likewise be a front panel mountable indicator, as is the credit display 16 or the bet display 22 illustrated in FIG. 1. The present invention can alternatively provide a separate "keep" simulated and/or front panel mountable selector and indicator (not illustrated) or any combination thereof. The game also preferably provides a suitable visual and/or audio prompt 60, which directs the player to keep a current award by selecting the "keep" button 52 or exchange it for one of the awards associated with symbols "A", "B" or "C".

Bonus Round Database

Referring now to FIG. 4, a schematic table illustrates a database of different values that the present invention can employ. Those skilled in the art of gaming device manufacturing can develop many different database structures of one or more databases, which the present invention could employ. The database of FIG. 4 is one possible database configuration that aids the description of the present invention.

The database of FIG. 4 includes a column 62 having three current player award ranges 25–100, 400–500 and 700–1000. These ranges include the player's currently held award for the beginning of an exchange sequence. The column 64 includes three corresponding consolation awards 20, 100 and 300. The game awards the consolation values when the player unsuccessfully attempts to exchange or upgrade the current award. The column 66 includes three upgrade award ranges 400–500, 700–1000 and 1500–3000. The game upgrades or exchanges the players current award with an upgrade award from the corresponding range upon a successful exchange. The upgrade range form a preceding row, e.g., row 76, thus becomes the player's current range in a succeeding row, e.g., row 78. The upgrade range of the final row 80 includes the ultimate award, i.e., 3000.

Columns 68, 70, 72 and 74 include increasing incremental tease awards. For instance, when the player's is risking a current award ranging from 700 to 1000 from row 90, the game can increase the award by 100, 200, 300 and 400 credits, each time prompting the player to decide whether to keep or continue. In this database example, the addition of 20, 30, 40, 50 credits to the highest possible current award, i.e., 100 of row 76 would not pierce or reach the upgrade range, i.e., 400–500. However, the addition of 50, 80, 100 and 150 credits to the highest possible current award, i.e., 500 of row 78 would pierce the upgrade range, i.e., 700–1000. The present invention can provide any value distpbution desired by the game's implementor.

It should be appreciated that the present invention preferably provides base game credit awards. Alternatively, the present invention can provide multiplier awards, a number of selections from an award pool or any other award contemplated by the implementor.

Initiator Sequence

Figure 5:
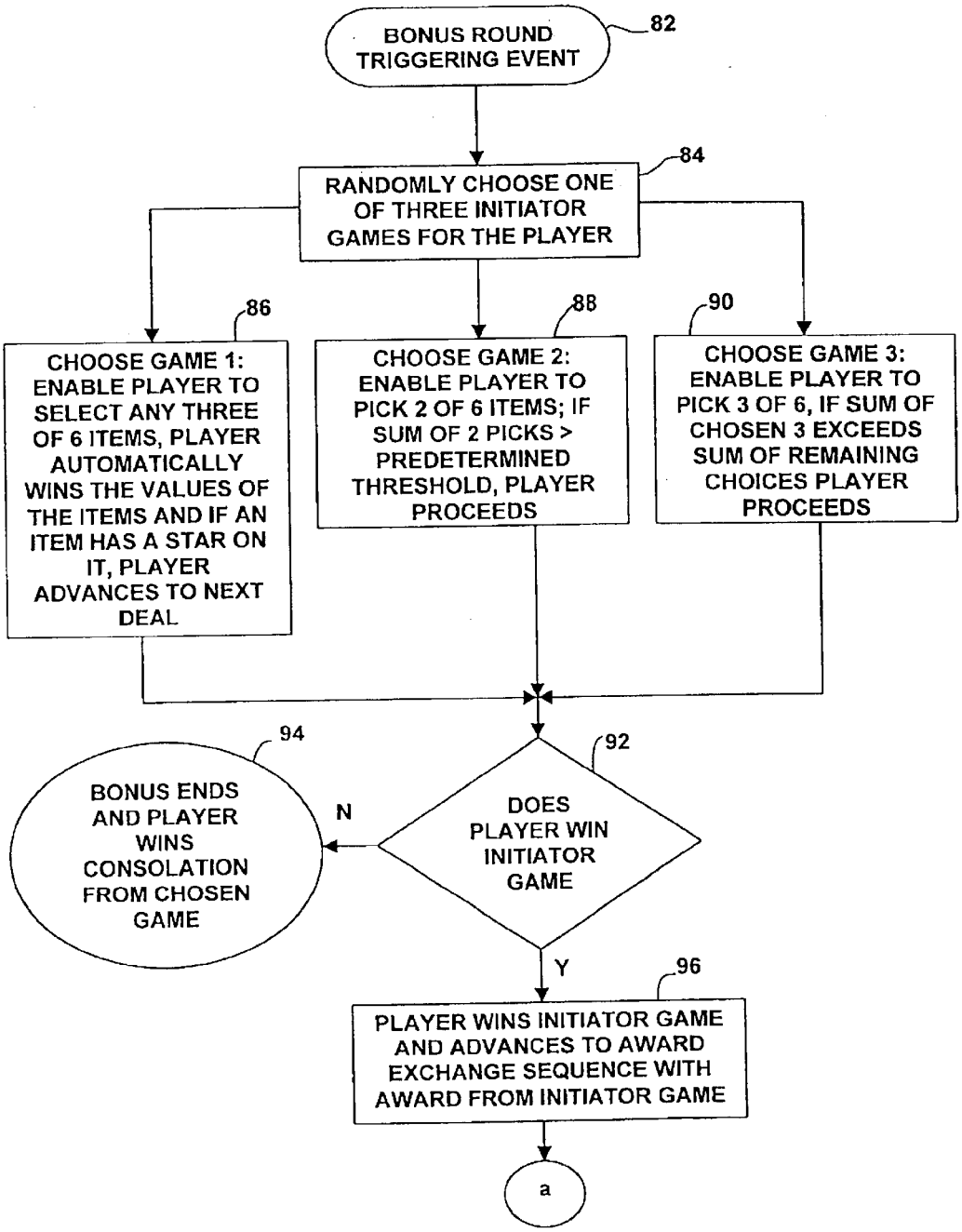
FIG. 5 is a process flow diagram of an initiator sequence embodiment, wherein upon a bonus round triggering event, the present invention randomly selects one of a plurality of initiator games for the player to play.

Referring now to FIG. 5, a process flow diagram of an indicator sequence of the present invention is illustrated. Upon a bonus round triggering event, indicated by the oval 82, the game randomly selects one of three initiator games for the player to play, as indicated by the block 84. The game can equally weight the changes of picking any particular initiator game or assign a weighted percentage to each. The game can make such determination at any prior point of the bonus round or base game of the gaming device. The present invention can store any number of initiator games and can employ multiple initiator games during any given bonus round.

The present invention can include any type of player selectable or game selectable initiator game. They are preferably short, involve at least some player involvement, have approximately a fifty percent chance of advancing the player and at least provide the player with a consolation award. If the present invention is a stand alone rather than a bonus game, there does not have to be a consolation award. The initiator game preferably provides a suitable audio or visual message describing the chosen game, such as "Select any three (of six) items, you automatically win the values of the items, and if an item has a star on it, you advance to the next deal", as indicated by block 86. In another initiator game, the player picks any two of six items, and if the sum of the chosen picks is ;greater than a predetermined value, the player advances, as indicated by block 88. In a further initiator game, the player picks any three of six items, if the sum of the chosen items exceeds the sum of the unselected items, the player advances, as indicated by block 90.

After the player picks from one of the initiator games, as indicated by blocks 86, 88 and 90, the game determines whether the player wins at the initiator game, as indicated by diamond 92. If the player does not pick items that enable the player to advance, the player wins a consolation award from the selected initiator game and the game of the present invention ends, as indicated by oval 94. The consolation awards are preferably a percentage of the player's current award range, as illustrated by columns 62 and 64 of FIG. 4. If the player does pick items that enable the player to advance, the player wins the initiator game and advances to one of the award exchange sequences, as illustrated by the block 96.

Preferred Award Exchange Sequence

Figure 6:
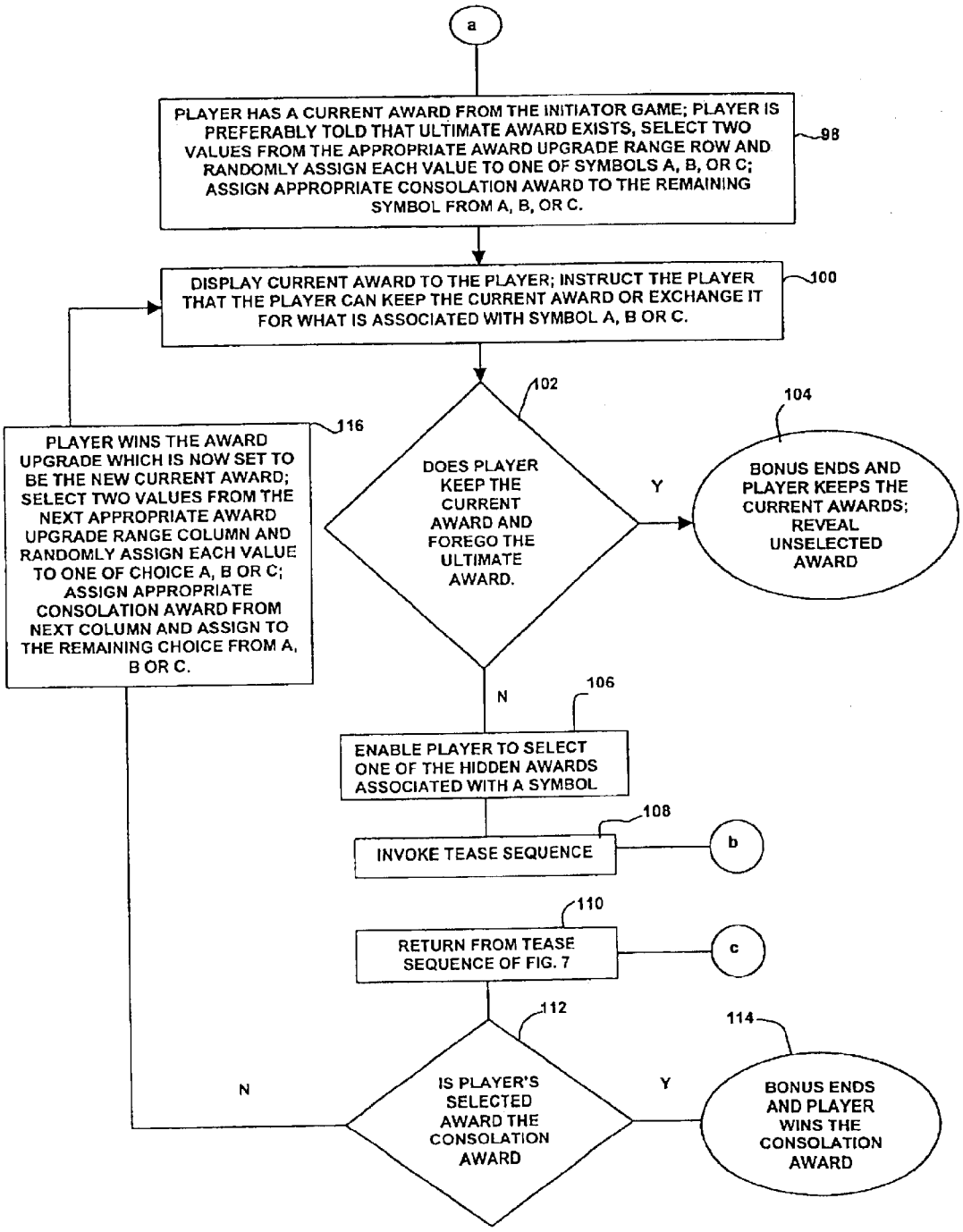
FIG. 6 is a process flow diagram of a preferred award exchange sequence embodiment, wherein the present invention automatically includes a tease sequence.

Referring now to FIG. 6, a process flow diagram of a preferred award exchange sequence embodiment is illustrated, wherein the present invention automatically includes a tease sequence. As indicated by the block 98 of FIG. 6, the player has a current award from the initiator game described in the process flow diagram of FIG. 5. The game preferably audibly or visually discloses to the player that an ultimate or big deal award is available to the player. The game selects two values from the appropriate award upgrade row of the database of FIG. 4 and randomly assigns each value to one of the symbols "A", "B" or "C" illustrated in FIG. 3. The game selects the corresponding consolation award from the same row of the database of FIG. 4 and assigns it to the remaining symbol "A", "B" or "C".

As indicated, by the block 100, the game displays the current award to the player and visually and/or audibly instructs or prompts the player to keep the current award or exchange it for what is associated with symbol "A", "B" or "C". If the player keeps the current award and forgoes the ultimate or big deal award, as indicated by a positive response to the query of diamond 102, the bonus round ends, the player keeps the current award and the game preferably reveals the award of the unselected symbols, as indicated by oval 104.

If the player does not keep the current award and plays for a chance at the ultimate or big deal award, as indicated by a negative response to the query of diamond 102, the game enables the player to select one of the hidden awards associated with a symbol disclosed in FIG. 3, as indicated by the block 106. After the player's selection, the present invention automatically invokes the tease sequence, as indicated by the block 108, regardless of whether the player selected an award upgrade or the consolation award. The tease sequence is described in connection with FIG. 7.

When the player returns from the tease sequence, as indicated by the block 110, the present invention makes a decision based upon whether the player selected one of the award upgrades or the consolation award. If the player selects the consolation award, as indicated by a positive response to the query of diamond 112, the bonus round ends, the player wins the appropriate consolation award from the database of FIG. 4, as indicated by the oval 114. The game may reveal the selected and/or unselected awards as discussed below.

If the player selects one of the award upgrades, as indicated by a negative response to the query of diamond 112, the bonus round continues and the player gets to play another award exchange or deal. In this example of the preferred embodiment, the player has a two in three chance of selecting an award upgrade and advancing to the next award exchange sequence. The present invention contemplates providing any such percentage of having the player advance.

As indicated by the block 116, the player wins the award upgrade, which the game sets to the player's current award in the next award exchange sequence. The game selects two new values from the next award upgrade row of the database of FIG. 4 and randomly assigns each value to one of the symbols "A", "B" or "C" illustrated in FIG. 3. The game selects the consolation award from the next consolation row of the database of FIG. 4 and assigns it to the remaining unassigned symbol "A", "B" or "C". The game then returns the player to instructional prompt indicated by block 100. The preferred award exchange sequence continues until the sequence ends as indicated by ovals 104, 114 or in ovals contained in the tease sequence of FIG. 7.

Tease Sequence

Figure 7:
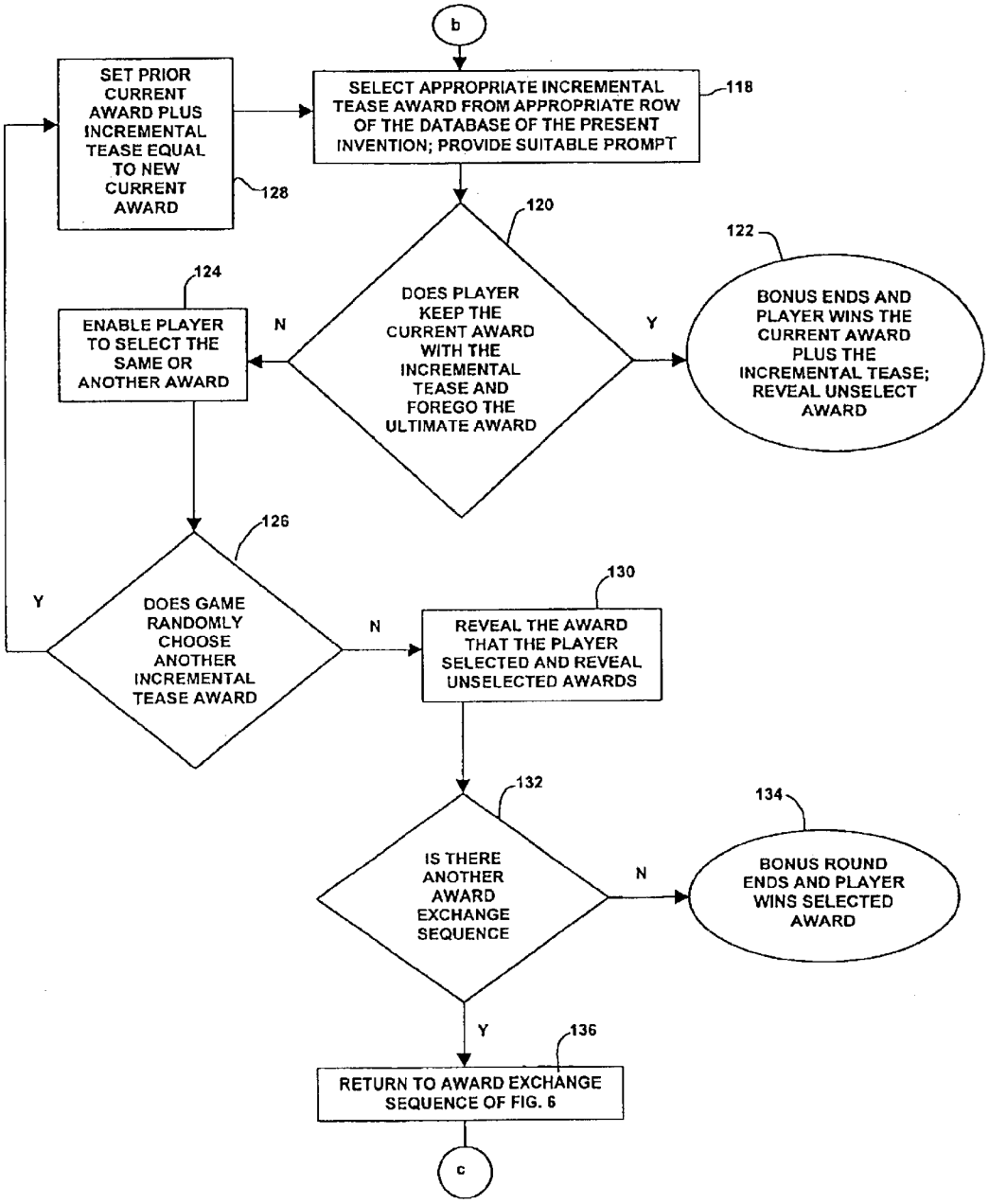
FIG. 7 is a process flow diagram of a tease sequence embodiment, wherein the present invention sequentially upgrades the player's award and requests the player to reselect whether to exchange the upgraded award.

Referring now to FIG. 7, a process flow diagram of a tease sequence is illustrated, wherein the present invention sequentially upgrades the player's current award and requests the player to reselect whether to exchange the upgraded current award. The game automatically invokes the tease sequence in the preferred award exchange embodiment disclosed in connection with FIG. 6 when the player decides not to keep the current award and play for a chance at the ultimate award.

As indicated by the block 118, upon invoking the tease sequence, the game selects an appropriate incremental tease award from the appropriate row of the database of FIG. 4. Referring to FIG. 4, beginning with the row 76, the game selects the first incremental tease award from the column 68, which is 20 credits. The game provides a suitable audio and/or visual prompt, such as "What is your decision now that we've added 20 credits to your current award?" The game also preferably updates the keep indicator 52 of FIG. 3 to reflect that the player has in fact been awarded the incremental tease amount. Note that the game can increment credits as illustrated or alternatively present a new total award and suitable prompt, such as "What is your decision now that your new current award is 80 credits?"

If the player keeps the current award with the incremental tease and forgoes the ultimate award, as indicated by a positive response to the query of diamond 120, the bonus round ends, the player keeps the current award plus the incremental tease award and the game preferably reveals the award of the unselected symbols, as indicated by oval 122. If the player does not keep the current award plus the incremental tease and plays for a chance at the ultimate award, as indicated by a negative response to the query of diamond 120, the game enables the player to select the same or a different one of the hidden awards associated with a symbol disclosed in FIG. 3, as indicated by the block 124. That is, the player preferably can change the player's mind and select a different symbol or stick with a prior selection.

After the player's selection, if the game randomly determines that another tease award exists, as indicated by a positive response to the query of diamond 126, the game sets the prior current award plus the prior incremental tease award to be the new player's current award, as indicated by the block 128. If the player's prior current award is 60 credits and the prior incremental tease award is 20, the player's new current award is now 80 credits. The game then again selects, as indicated by the block 118, the appropriate incremental tease award from the appropriate row of the database of FIG. 4, which is the same row used in the prior tease sequence loop. That is, referring again to the row 76 of FIG. 4, the game now selects the second incremental tease award from the column 70, which is 30 credits. The game likewise provides a suitable audio and/or visual prompt, such as "Well, let's see what your decision would be if we added another 30 credits to your current award?" The game also preferably updates the keep indicator 52 of FIG. 3 to reflect that the player has in fact been awarded the incremental tease amount of 30 credits.

Referring again to FIG. 4, the sample database of the present invention illustrates four incremental tease awards 68,70,72 and 74 with each row, namely, rows 76, 78 and 80. The present invention contemplates providing any number of possible incremental tease awards. The present invention also contemplates randomly selecting and adding less than all of the tease awards to the player's current award. Although not illustrated, the game can maintain a tease probability distribution, for example, a 10% chance that the game adds only the first tease, a 40% change that the game adds on the first and second teases, a 40% chance that the game adds the first, second and third teases and a 20% chance that the game adds all four teases.

The game can provide any tease probability distribution. The game provides the tease probability distribution so that the player does not learn a set pattern and automatically wait for a preset two, three or four incremental teases awards before making a decision to keep or try for the ultimate award.

Referring again to FIG. 7, after the player's selection, if the game randomly determines that no other tease award exists, as indicated by a negative response to the query of diamond 126, the game preferably reveals the award of the symbol selected by the player as well as the award of the unselected symbols, as indicated by the block 130. Revealing the player's relative success or failure at selecting a masked or hidden award increases player excitement and enjoyment.

If there is no other award exchange sequence in the bonus round of the present invention as indicated by a negative response to the query of diamond 132, the bonus round ends and the player wins the award associated with the player's selected symbol, as indicated by the oval 134. Determining whether another award exchange sequence exists involves determining whether another row of the sample database of FIG. 4 exists. Once the player, for example, exhausts the rows 76, 78 and 80 of FIG. 4, the bonus round ends. The 3000 credits of the row 80 of FIG. 4 is thus the game's ultimate award.

If there is another award exchange sequence in the bonus round of the present invention, as indicated by a positive response to the query of diamond 132, the game preferably returns the player to the award exchange sequence of FIG. 6. As disclosed above in FIG. 6, the game then determines whether the player advances (exchanges award for player selected upgrade) or whether the bonus round ends (player selects consolation award), as indicated by diamond 112.

Alternative Embodiment

Figure 8:
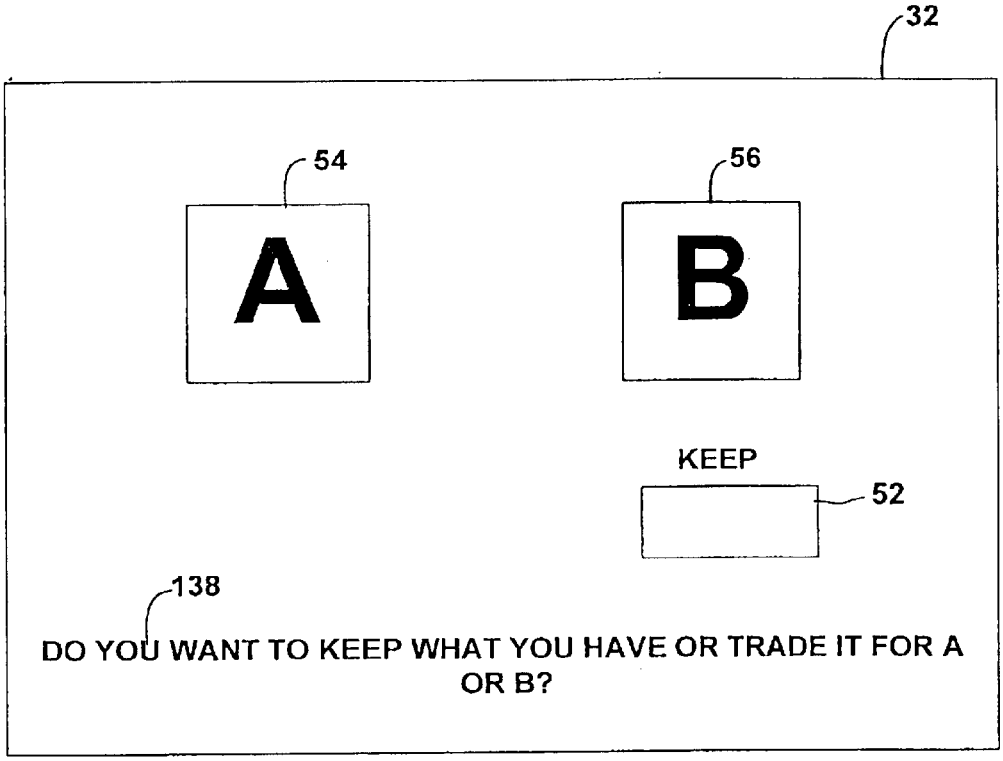
FIG. 8 is an enlarged front plan view of the display device generally displaying the components of an alternative award exchange embodiment of the present invention.

Referring now to FIG. 8, an enlarged front plan view of the display device generally is shown displaying the components of an alternative award exchange embodiment of the present invention. In FIG. 8, like in FIG. 3. the display device 32 preferably includes a touch screen 46 and an associated touch screen controller 48 discussed in FIG. 2. The alternative embodiment also provides the keep selector and indicator 52, which updates and displays the value of the player's current award. In FIG. 8, unlike FIG. 3, the game only provides the two selectors 54 and 56, which as before are associated with the symbols "A" and "B", respectively. The game also preferably provides a suitable visual and/or audio prompt 138, which now directs the player to keep a current award by selecting the keep button 52 o exchange it for one of the two prizes associated with symbols "A" or "B".

A suitable sample database for the alternative embodiment is the database of FIG. 4. In the alternative embodiment, however, the present invention selects only one award upgrade from the ranges of column 66, rather than two, as before. As with the preferred embodiment, the database of FIG. 4 illustrates only one example of many possible database structures that the implementor can employ.

Referring now to FIG. 9, a process flow diagram of an alternative award exchange sequence is illustrated, wherein the present invention includes a tease sequence when the player unsuccessfully attempts to exchange a currently held award. As disclosed with respect to the preferred embodiment, the alternative embodiment can have any player advancement percentage, which the game controls by providing different numbers of selectors. Three selectors produced a two in three chance of advancement. Providing only two selectors gives the player a one in two chance to advance. Providing five selectors wherein two associate with a consolation award alternatively gives the player a three in five chance of advancement.

The preferred embodiment can have any number of symbols including two as described with respect to FIG. 8. Likewise, the alternative embodiment can have any number of symbols including three as described above with respect to FIG. 3. The difference in the embodiments occurs in the award exchange sequence, wherein (i) the alternative embodiment only triggers the tease sequence when the player selects the consolation award (i.e., player will not advance) and (ii) the tease sequence is not automatically triggered in the event that the player selects the consolation award.

As indicated by the block 140 of FIG. 9, the player has a current award from the initiator game described in the process flow diagram of FIG. 5. The game preferably audibly or visually discloses to the player that an ultimate award is available to the player. The game selects a value from the appropriate award upgrade row of the database of FIG. 4 and randomly assigns the value to one of the symbols "A" or "AB" illustrated in FIG. 8. The game selects the corresponding consolation award from the same row of the database of FIG. 4 and assigns it to the remaining symbol "A" or "B".

As indicated by the block 142, the game displays the current award to the player and visually and/or audibly instructs or prompts the player to keep the current award or exchange it for what is associated with symbol "A" or "B". If the player keeps the current award and forgoes the ultimate or big deal award, as indicated by a positive response to the query of diamond 144, the bonus round ends, the player keeps the current award and the game preferably reveals the award of the unselected symbol, as indicated by oval 146.

If the player does not keep the current award and plays for a chance at the ultimate award, as indicated by a negative response to the query of diamond 144, the game enables the player to select one of the hidden awards associated with a symbol disclosed in FIG. 8, as indicated by the block 148. After the player selects one of the masked or hidden awards, the present invention makes a decision based upon whether the player selected the award upgrade or the consolation award.

The present invention invokes the tease sequence of FIG. 7 preferably, only if the player selects the consolation award, as indicated by a positive response to the query of diamond 150. Even then, the game randomly decides whether to invoke the tease sequence. If the game does not invoke the tease sequence, as indicated by a negative response to the query of diamond 152, the bonus round ends, the player wins the selected consolation award from the database of FIG. 4 and the game reveals the unselected award upgrade, as indicated by the oval 154.

The game randomly decides whether to invoke the tease sequence based upon any probability distribution desired by the implementor. The game can invoke the tease sequence a predetermined percent of the time, such as fifty percent, whenever the player selects the consolation award. The game can alternatively vary the percentage, for example, set a 90% chance invoking the tease sequence if the player selects the consolation award on the first award exchange sequence, 50% if the player selects the consolation award on the second award exchange sequence, etc.

If the game invokes the tease sequence, as indicated by a positive response to the query of diamond 152, the game invokes substantially the same tease sequence as described above in FIG. 7. Referring to FIG. 7, there are two differences in the tease sequence of the alternative embodiment from that of the preferred embodiment. First, the block 124 enabling a player to change the player's mind does not exist and thus if a player does not keep the current award with the incremental tease, as indicated by the negative response to diamond 120, the game automatically determines if another incremental tease award exists, as indicated by the block 126. The game only invokes the tease sequence in this embodiment when the player selects the consolation award and therefore the game preferably does not enable the player to have a change of mind and possibly select the award upgrade.

Second, diamond 132 in which the game determines whether another award upgrade exists is not applicable in the alternative embodiment because the player has permanently selected the consolation award, i.e., the game ending award. After the revealing the selected and unselected awards in block 130, the game automatically ends and the player wins the selected award as indicated by the oval 134. In the alternative embodiment, the game does not return to the award exchange sequence from the tease sequence, as indicated by the block 136. In all other respects the tease sequence is the same for the alternative embodiment; namely, the game randomly selects and adds any number of incremental tease awards, as indicated by diamond 126. Again, the present invention preferably varies the number of incremental tease additions so that the game does not become predictable.

Referring again to FIG. 9 and specifically to diamond 150, if the player selects the award upgrade, as indicated by a negative response to the query of diamond 150, the bonus round determines if another award exchange sequence exists, as indicated by diamond 156. If not, as indicated by the negative response to the query of diamond 156, the bonus round ends, the player wins the award upgrade, which can be the ultimate award, and the game reveals the unselected award, as indicated by the block 158. It should be appreciated that this embodiment does not enable the player to rejuvinate or drive the bonus round in the tease sequence by selecting another symbol after selecting the hidden consolation award. At the same time, the alternative embodiment does not enable the player to ruin or end the round after selecting the hidden award upgrade.

If another award exchange sequence exists, as indicated by the positive response to the query of diamond 156, the game continues and the player gets to play another award exchange or deal. In this example of the alternative embodiment, the player has a one in two chance of selecting an award upgrade and advancing to the next award exchange sequence. The present invention contemplates providing any such percentage of having the player advance.

As indicated by the block 160, the player wins the award upgrade, which the game sets to be the player's current award in the next award exchange sequence. The game selects a new value from the next award upgrade row of the database of FIG. 4 and randomly assigns it to one of the symbols "A" or "B" illustrated in FIG. 8. The game selects the consolation award from the next consolation row of the database of FIG. 4 and assigns it to the remaining symbol "A" or "B". The game then returns the player to the instructional prompt indicated by block 142. The alternative award exchange sequence continues until the sequence ends as indicated by ovals 146, 154 or in ovals contained in the tease sequence of FIG. 7.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

What is claimed is:

1. A method for operating a player tease sequence in a gaming device under the control of a processor, said method comprising the steps of:

(a) after accepting an input designating a player's decision to risk a known currently held award to try for a higher value award exchange, increasing, said currently held award by at least one increment, wherein said increment is randomly determined from at least one predetermined range which is based on said higher value;

(b) without revealing a determination of said player's success, enabling said player to input into the processor a decision to keep said increased award or to input into said processor a decision to risk losing said increased award to try for said higher value award exchange; and (c) ending said tease sequence if said player inputs said decision to keep said increased award.

2. The method of claim 1, which includes the step of repeating steps (a) through (c) at least one time, each time increasing said increased award.

3. The method of claim 1, which includes the step of repeating steps (a) through (c) a randomly determined number of times, each time increasing said increased award.

4. The method of claim 1, which includes the step of exchanging said currently held award with said higher value award if said input to try for said higher value award exchange after step (b) is successful.

5. The method of claim 1, which includes the step of exchanging said currently held award with a lower value award if the determination of said input designating said player's decision before step (a) is unsuccessful, and said player inputs decision said to try for said higher value award exchange in step (b).

6. The method of claim 5, which includes the step of revealing said higher value award and said lower value award.

7. The method of claim 1, which includes the step of revealing said higher value award and a lower value award if said player inputs said decision to keep said increased award.

8. A method for operating an award exchange sequence in a gaming device, said method comprising:

(a) enabling a player to input into a processor a decision to keep a currently held award or to input Into the processor a decision to risk losing the currently held award to try for one of a plurality of other awards which include a higher value award than the currently held award, and wherein the inputted decision can produce a successful outcome or an unsuccessful outcome for the player in the sequence;

(b) lending said sequence if the player inputs the decision to keep the currently held award;

(c) if and after the player inputs the decision to try for one of the other awards, randomly determining whether the successful outcome or the unsuccessful outcome occurs by randomly determining if the player's inputted decision yields the higher value award; and (d) if and after the player inputs the decision to try for one of the other awards, performing a player tease sequence wherein the currently held award is increased to a value less than the average value of the other awards but greater than the currently held value if the unsuccessful outcome occurs.

9. A method for operating a gaming device under the control of a processor, said method comprising:

(a) enabling a player to input a decision into the processor to keep a currently held award or to input a decision to risk losing the currently held award to try for a higher value award, and wherein the inputted decision to try for the higher value award can produce a successful outcome or an unsuccessful outcome for the player;

(b) providing the currently held award to the player if the player inputs the decision to keep the currently held award; and (c) if and after the player inputs the decision to try for the higher value award, randomly determining whether the successful outcome or the unsuccessful outcome occurs, providing the higher value award to the player if the successful outcome occurs, and if said unsuccessful outcome occurs:

(i) randomly determining whether to increase the currently held award based on a probability, (ii) providing an award less than the currently held award to the player if said determination is not to increase the currently held award, and (iii) if said determination is to increase the currently held award, increasing the currently held award and enabling the player to input a decision to keep the increased currently held award or to input a decision to risk losing the currently held award to try for the higher value award, providing the increased currently held award to the player if the player inputs the decision to keep the increased currently held award, and if and after the player inputs the decision to try for the higher value award instead of the increased currently held award, randomly determining whether to provide the higher value award to the player, and providing the higher value award or an award less than the increased currently held award to the player based on such determination.

10. A gaming device comprising:

a currently held award;

a plurality of other awards, wherein said plurality of other awards includes a higher value award than the currently held award;

a display device; and a processor operable with said display device to:

(a) enable a player to input a decision to keep the currently held award or to risk losing the currently held award to try for one of said plurality of other awards, wherein the inputted decision can produce a successful outcome or an unsuccessful outcome for the player, (b) perform a terminating event if the player inputs the decision to keep the currently held award; and (c) if and after the player inputs the decision to try for one of the other awards:

(i) randomly determine whether the successful outcome or the unsuccessful outcome occurs by randomly determining if the players inputted decision yields the higher value award, and (ii) perform a player tease sequence wherein the currently held award is increased to a value less than the average value of the other awards but greater than the currently held value if the unsuccessful outcome occurs.

11. A gaming device comprising:

a display device; and a processor operable with said display device, wherein after accepting an input designating a player's decision to risk a currently held award to try for a higher value award, said processor is operable to:

(a) increase said currently held award by at least one increment to form an increased award, wherein said increment is randomly determined from at least one predetermined range which is based on said higher value award;

(b) display said increased award to the player;

(c) without revealing a determination of the player's success at obtaining said higher value award, enable the player to input a decision to keep said increased award or to risk losing said increased award to try for said higher value award; and (d) perform a terminating event if the player inputs the decision to keep the increased award.

12. The gaming device of claim 11, wherein the processor is operable to repeat steps (a) through (d) at least one time, each time increasing the increased award.

13. The gaming device of claim 11, wherein the processor is operable to repeat steps (a) through (d) a randomly determined number of times, each time increasing the increased award.

14. The gaming device of claim 11, wherein the processor is operable to enable the player to exchange the currently held award with the higher value award if the player's decision to risk losing said increased award to try for said higher value award is successful.

15. The gaming device of claim 11, wherein the processor is operable to enable the player to exchange the currently held award with a lower value award if the player's designation to risk the currently held award to try for said higher value award is unsuccessful and the player inputs a decision to risk losing said increased award to try for said higher value award.

16. The gaming device of claim 15, wherein said processor is operable to reveal said higher value award and said lower value award.

17. The gaming device of claim 11, wherein the processor is operable to reval said higher value award and a lower value award if the player inputs the decision to keep said increased award.

18. A gaming device comprising:

a display device; and a processor operable with said display device to:

(a) display a currently held award to a player;

(b) enable the player to input a decision to keep the currently held award or to risk losing the currently held award to try for a higher value award, wherein the inputted decision to try for the higher value award can produce a successful outcome or an unsuccessful outcome for the player;

(c) provide the currently held award to the player if the player inputs the decision to keep the currently held award;

(d) if and after the player inputs the decision to try for the higher value award, randomly determine whether the successful outcome or the unsuccessful outcome occurs, (e) display and provide the higher value award to the player if the successful outcome occurs, and (f) if said unsuccessful outcome occurs:

(i) randomly determine whether to increase the currently held award based on a probability, (ii) display and provide an award less than the currently held award to the player if said determination is not to increase the currently held award, and (iii) if said determination is to increase the currently held award, increase the currently held award and enable the player to input a decision to keep the increased currently held award or to input a decision to risk losing the currently held award to try for the higher value award, display and provide the increased currently held award to the player if the player inputs the decision to keep the increased currently held award, and if and after the player inputs the decision to try for the higher value award instead of the increased currently held award, randomly determine whether to provide the higher value award to the player, and display and provide the higher value award or an award less than the increased currently held award to the player based on such determination.

* * * * *

UNITED STATES PATENT AND TRADEMARK OFFICE

CERTIFICATE OF CORRECTION

PATENT NO. : 6,811,483 B1
DATED : November 2, 2004
INVENTOR(S) : Webb et al.

It is certified that error appears in the above-identified patent and that said Letters Patent is hereby corrected as shown below:

Column 1,
Line 65, please change “consolabon” to -- consolation --.

Column 3,
Lines 4-5, please change “which CD awards” to -- which awards --.

Column 8,
Line 8, please change “column 66” to -- column 64 --.
Line 18, please change “from row 90, the” to -- from row 80, the --.

Column 10,
Line 9, please change “unassigned symbol” to -- symbol --.

Column 11,
Line 9, please change “68,70,72 and 74 with each” to -- with each --.

Column 12,
Line 45, please change “or “AB” illustrated” to -- or “B” illustrated --.

Column 13,
Line 41, please change “revealing the selected” to -- revealing of the selected --.

Column 14,
Line 63, please change “inputs decision said” to -- inputs said decision --.

Column 15,
Line 16, please change “lending said” to -- ending said --.

Signed and Sealed this

Nineteenth Day of April, 2005

JON W. DUDAS
*Director of the United States Patent and Trademark Office*